US006113844A

United States Patent [19]

Neale

[11] Patent Number: 6,113,844

[45] Date of Patent: Sep. 5, 2000

[54] PROCESS FOR PELLETIZING PARTICULATE MATERIALS

[75] Inventor: Martin Geoffrey Neale, West Yorkshire, United Kingdom

[73] Assignee: Ciba Specialty Chemicals Water Treatments Limited, West Yorkshire, United Kingdom

[21] Appl. No.: 09/026,477

[22] Filed: Feb. 19, 1998

[30] Foreign Application Priority Data

Feb. 20, 1997 [GB] United Kingdom ..... 9703500

[51] Int. Cl.[7] ..... C04B 33/32

[52] U.S. Cl. ..... 264/670; 264/669

[58] Field of Search ..... 264/669, 670, 264/603

[56] References Cited

U.S. PATENT DOCUMENTS

| | | | |
|---|---|---|---|
| 4,342,599 | 8/1982 | Mann et al. | 106/100 |
| 4,751,259 | 6/1988 | Roe et al. | 524/52 |
| 5,171,361 | 12/1992 | Dingeman et al. | 75/772 |
| 5,306,327 | 4/1994 | Dingeman et al. | 75/313 |
| 5,821,283 | 10/1998 | Hesler et al. | 523/161 |

FOREIGN PATENT DOCUMENTS

| | | | |
|---|---|---|---|
| 0 376 713 A2 | 7/1990 | European Pat. Off. | C22B 1/244 |
| 2 006 179 | 5/1979 | United Kingdom | C22B 1/244 |

*Primary Examiner*—Christopher A. Fiorilla
*Attorney, Agent, or Firm*—David R. Crichton

[57] ABSTRACT

The present invention relates to a method for ore pelletization including the step of adding binder polymer to particulate ore and moisture to form an intimate mixture. Green pellets are formed from the mixture and fired. A water soluble treatment polymer having a molecular weight of 1,000 to 20,000 is included in the intimate mixture in an amount of at least 0.001% by weight. The water soluble treatment polymer is formed by polymerization of water soluble ethylenically unsaturated monomer blend containing at least 50% by weight of anionic monomer.

18 Claims, No Drawings

PROCESS FOR PELLETIZING PARTICULATE MATERIALS

This invention relates to the pelletisation of particulate metal ore using a polymeric binder and, in particular, to the incorporation of an additive to improve the effectiveness of the binder.

Ore pelletisation processes comprise adding binder to particulate ore and moisture and thereby forming an intimate mixture of ore, binder and moisture, forming green pellets of the mixture and firing the green pellets.

Traditionally the binder was bentonite clay but in recent years natural and synthetic organic binder polymers have been proposed and used. The natural binder polymers include starches.

The synthetic binder polymers which have proved most successful have intrinsic viscosity (IV) generally in the range about 4 to 10 dl/g but values as low as 2 dl/g or as high as 16 dl/g or more have been proposed. Thus the synthetic polymers all have a molecular weight of for instance above 1 million and generally of several million. An example of a disclosure of use of synthetic binder polymers having molecular weight at least 1 million is U.S. Pat. No. 4,751,259.

In this specification, IV is determined by suspended level viscometer using a 1M sodium chloride solution buffered to pH 7 at 25° C.

The organic binder polymer is generally added in the form of fine powder typically having a size at least 90% by weight below 200 $\mu$m, but in EP 376,713 we describe the use of aggregates formed from this powder and, optionally, non-polymeric pelletising aid such as sodium carbonate. Although we describe that the aggregates are generally made merely by wetting the binder polymer and pelletising aid we do mention in EP 376,713 that an aggregate bonding agent can be used in an amount usually below 10% and frequently 0.05 to 1% based on the weight of the aggregate. Thus the amount of aggregate bonding agent is very low. We state that it is preferably a non-ionic polymer but that, when the binder polymer is anionic, the aggregate bonding agent can be a low molecular weight (often below 10,000) anionic polymer such as sodium polyacrylate. When, as is typical, the amount of aggregated binder is 0.06% based on the intimate mix of ore and binder the amount of aggregate bonding agent (at the normal upper limit of 1% based on the weight of aggregate) is 0.0006%. There is no suggestion in EP 376,713 that the aggregate bonding agent serves any useful purpose in the process other than facilitation of the manufacture and incorporation of the aggregates.

The quality of the final pellets in ore pelletisation is assessed on the basis of various properties including wet or green strength, dry strength and drop number. The values obtainable at any particular plant tend to vary from one plant to another because of variations in the materials used (for instance the ore quality) and the processing conditions but, as a generality, it is desirable to try to maximise the dry strength while maintaining satisfactory results for the drop number and other properties.

U.S. Pat. No. 5,171,361 is concerned with improving processes of pelletisation in which the binder polymer is a starch based polymer. In particular, it is concerned with alleviating problems which are found specific to processes in which starch is used as the binder. These are problems of rapid and uneven ball growth and problems with surface properties such as surface stickiness and surface cratering. Various additives are suggested to solve these problems which are encountered with starch binder. Acrylic polymers are included in an extensive list of suitable materials. Various examples are given of binder blends including various acrylic polymers. Of these, nonionic high molecular weight polyacrylamide appears to be preferred, although materials described as "high molecular weight anionic acrylamide", "medium molecular weight anionic acrylamide", and "low molecular weight anionic acrylamide" are also suggested. No indication is given of the content of anionic monomer in the anionic polyacrylamides. In particular, it is believed that the material described as "low molecular weight anionic acrylamide" would in fact have molecular weight of at least 1 million. Two examples also include what is described as "neutralised polyacrylic acid" in combination with, respectively, guar gum and a terpolymer of 30% acrylic acid/10% AMPS/60% acrylamide. No indication is given of the molecular weight of the neutralised polyacrylic acid or terpolymer. All of those suggested materials are thus likely to be in the class of known synthetic binder materials discussed above. Further, although the citation discloses that the additives used improve the problems specific to starch binder (surface erosion, balling rate etc), it specifically states that dry strength and drop strength are the same with and without the additive material, and may even be better without it.

U.S. Pat. No. 5,306,327 is a similar disclosure. In addition it suggests lignosulphonates as additives for solving the problems encountered with starch as binder. Lignosulphonates are natural polymeric materials which tend to be variable in their properties. These materials, although described as having "relatively low molecular weight", are stated to have a molecular weight distribution ranging from 100 to 100,000.

GB 2,006,179 is a publication which generally mentions agglomeration but is primarily concerned with briquetting and not pelletisation. Two proprietary materials are suggested to improve briquetting, again in combination with starch binder. These materials are Reversand SS100 and Daxad 15.

It would be desirable to be able to improve pelletisation processes by increasing the dry strength for pellets formed using a range of binders, especially with those feedstocks and processes where the binder polymer would otherwise tend to give a dry strength lower than is desired. In particular, it would be desirable to be able to improve pelletisation processes in which a synthetic polymer is used as the main binder polymer.

An ore pelletisation process according to the invention comprises adding binder polymer to particulate ore and moisture and thereby forming an intimate mixture of ore, binder and moisture, forming green pellets from the mixture and firing the green pellets, and in this process at least 0.001% by weight (based on the intimate mixture) of a water soluble treatment polymer is included in the intimate mixture of ore, binder polymer and moisture, wherein the water soluble treatment polymer has molecular weight 1,000 to 20,000 and is a synthetic polymer formed by polymerisation of water soluble ethylenically unsaturated anionic monomer or water soluble ethylenically unsaturated monomer blend containing at least 50% by weight anionic monomer.

The treatment polymer is generally formed of 50 to 100%, preferably 75 or 80 to 100%, by weight anionic monomer with the balance being non-ionic monomer which will form a water soluble blend with the anionic monomer. The non-ionic monomer can be a water soluble monomer such as acrylamide or it can be a potentially water insoluble monomer such as an alkyl acrylate or methacrylate, for instance methyl or butyl acrylate, provided that this insoluble monomer can be dissolved in an aqueous solution of the anionic monomer during polymerisation and that the blend provides a water soluble polymer.

The anionic monomer is generally ethylenically unsaturated carboxylic monomer, usually in the form of an alkali metal (especially sodium) or other water soluble salt, but if desired some or all of the anionic monomer can be an ethylenically unsaturated sulphonic monomer such as AMPS (U.S. trade mark) or allyl sulphonate or vinyl sulphonate. The preferred carboxylic monomers are acrylic or methacrylic acid and most preferably the anionic monomer is sodium acrylate. The preferred polymers are homopolymers of acrylic acid (usually as sodium polyacrylate).

The molecular weight of the treatment polymer is preferably at least 2,000 or 3,000. Often it is below 10,000 and preferably below 8,000, with values of around 3,000 to 6,000 often being preferred. In this specification molecular weight is weight average molecular weight. Molecular weight is measured by gel permeation chromatography, preferably measured by size exclusion chromatography using Toao Haes TSK PWXL (G6000+G3000+guard) columns or other suitable columns, dipotassium hydrogen orthophosphate trihydrate as eluant, and several sodium polyacrylate standards in the range 782200–1250 g/mol with sodium acrylate monomer as an additional standard. Molecular weights are measured as the full sodium salt.

Preferred treatment polymers also have narrow molecular weight distribution as well as the defined very low molecular weight.

Higher molecular weights within the range of 1,000 to 20,000 are sometimes more suitable when, as is sometimes preferred, the polymer is to be introduced in bead form. When the treatment polymer is to be supplied in liquid form, the polymer is usually made by solution polymerisation in conventional manner. When the polymer is supplied in powder form, the polymer is usually made by reverse phase bead polymerisation or by spray drying a solution of the polymer.

If the treatment polymer is in particulate form, it generally has a particle size at least 90% by weight below 300 $\mu$m and most preferably below 200 $\mu$m and often below 100 $\mu$m. Usually the particle size is at least 90% by weight above 10 $\mu$m.

It will be appreciated that the water soluble treatment polymers used in the invention are materials which are known in the industry as dispersing agents and it is surprising that the addition of a synthetic polymeric dispersing agent is beneficial in the process. What we find, however, is that it is possible to obtain improved dry strength by the incorporation of the treatment polymer, and in particular it is possible to achieve this when the total amount of binding system (binder polymer, treatment polymer and possible pelletisation aid when used) remains constant.

The amount of treatment polymer which has to be added will vary according to the nature of the ore and the remainder of the binder system but is often at least 0.005% and most preferably is at least 0.008%. Often it is in the range 0.01 to 0.05%. Amounts above 0.1% are usually unnecessary but can be used if desired. These amounts are all by weight based on the intimate mixture of ore, polymer binder and moisture.

The treatment polymer can be incorporated in the intimate mixture of ore, binder polymer and moisture by addition at any suitable stage. It is often desirable to mix the treatment polymer intimately with the ore and some or all of the moisture before adding the binder polymer or other components of the binder system. For instance the treatment polymer can be added as a liquid or powder prior to the filters which conventionally precede the addition to binder prior to pelletisation in a drum or disc.

One group of preferred processes therefore includes sequential addition of the treatment polymer followed by the binder polymer. However sequential addition is not essential and good results can also be obtained by the addition of the treatment polymer to the intimate mix at the same time as adding the binder polymer (or subsequently). The treatment and binder polymers are generally added separately, that is to say from separate supplies, either simultaneously or sequentially in either order. This facilitates the possibility of adding the treatment and binder polymers in different physical forms, for instance the treatment polymer as a solution and the binder polymer as a powder. In particular the treatment polymer may be added as a solution before the filters and the binder polymer as a powder after the filters but before pelletisation.

Although it is often convenient to add the treatment polymer as a solution, it is usually preferred to add it as a powder. The powder particles may be added separately from the binder polymer (often at the same time as the binder polymer) but often the treatment polymer particles may be added as a blend with binder polymer particles.

Instead of adding the treatment polymer as a solution or a blend of particles with particles of binder polymer, some of the treatment polymer can serve also as an aggregate bonding agent for aggregates of polymer binder particles, as in EP 376,713. However it is necessary that those aggregates should be disintegratable, as described in EP 376,713, and it is not usually practicable to make disintegratable aggregates containing both the binder polymer and all the desired treatment polymer. Accordingly if the binder polymer is to be introduced in the form of aggregates it is usually preferred that these do not include treatment polymer as a bonding agent and usually it is preferred that they do not contain any treatment polymer or, if they do, the amount of treatment polymer in the aggregates should be not more than 50%, and generally not more than 10%, by weight of the total amount of treatment polymer used in the invention.

The binder polymer can be a natural or modified natural binder polymer such as a starch or cellulose, for instance carboxy methyl cellulose polymer but is preferably a synthetic polymer, for instance formed from a water soluble ethylenically unsaturated monomer or monomer blend. It can be substantially non-ionic but generally it is an ionic synthetic polymer formed from anionic or cationic monomer, optionally with a non-ionic monomer. It may be amphoteric, being formed from a mixture of cationic and anionic monomers, optionally with non-ionic monomer.

Although the binder polymer can be a natural or modified natural polymer, the invention provides particular benefits when the binding polymer comprises synthetic polymer in particular synthetic ionic polymer. In particular, the invention has particular advantages when the binder polymer comprises at least 50 wt. % synthetic ionic polymer, preferably at least 80 wt. % synthetic polymer and especially when it comprises substantially 100% synthetic ionic polymer. The binder polymer may be a mixture of synthetic ionic polymer and natural or modified natural polymer.

Suitable anionic monomers are ethylenically unsaturated carboxylic acids or sulphonic acids, often in the form of a water soluble ammonium or, preferably, alkali metal salt. Suitable carboxylic acids are methacrylic, itaconic, maleic or, preferably, acrylic acid. Suitable sulphonic acids include allyl, methallyl, vinyl and 2-acrylamido-2-methyl propane sulphonic acids, usually as alkali metal salt.

Suitable cationic monomers include dialkylaminoalkyl (meth)-acrylamides or -acrylates, usually as acid addition or quaternary ammonium salts, and monomers such as diallyl dimethyl ammonium chloride.

Suitable non-ionic monomers include methacrylamide and acrylamide.

The preferred synthetic binder polymers are usually anionic. The binder polymer can be a polymer of more than 50% anionic monomer (for instance sodium polyacrylate homopolymer) but it is generally preferred for the binder polymer to be formed from less than 70%, often 5 to 45%, by weight of anionic monomer with the balance being non-ionic monomer, generally acrylamide. Preferred polymers are formed from 10 to 40%, preferably 15 to 30%, sodium acrylate or other anionic monomer with the balance being acrylamide. Preferred polymers are described in EP 225,171 and EP 288,150.

The synthetic binder polymer is usually wholly linear, that is to say it is formed without the addition of cross linking agent, but if desired it can be slightly cross linked provided it is still water soluble, as described in W093/03190.

The molecular weight of the binder polymer will normally be selected so that the binder polymer has the desired binding properties, and thus normally the molecular weight is above 1 million. The intrinsic viscosity is generally above 2 or 3 dl/g, and often above 4 dl/g. When the polymer is cationic, values of up to 12 or 15 dl/g are usually adequate but when the polymer is non-ionic or anionic values of up to 25 or 30 dl/g may be used. However the preferred materials are anionic polymers made from a water soluble blend of non-ionic ethylenically unsaturated monomer (generally acrylamide) and ethylenically unsaturated carboxylic monomer. The amount of this monomer is generally in the range 5 to 30 or 40%, preferably 5 to 20%, by weight of total monomers. The polymer preferably has intrinsic viscosity of from 2 to 16 dl/g, and for most purposes an intrinsic viscosity of about 3 to 10 dl/g is preferred, often 3 to 7 dl/g.

Blends of synthetic polymer and natural polymer may be used, for instance as described in W093/03189. Preferred blends are of anionic synthetic polymer and guar gum.

Although the synthetic polymers can be introduced in the form of, for instance, substantially anhydrous polymer in oil dispersions or emulsions, the binder polymer is preferably introduced in powder form. The individual particles of the binder polymer are usually of size mainly below 300 $\mu$m and most usually mainly below 200 $\mu$m and often mainly below 100 $\mu$m, e.g., at least 90% by weight below 200 $\mu$m and at least 40% below 100 $\mu$m. Generally they are at least 10 $\mu$m, but they can be smaller, e.g., 1 $\mu$m or less. They can be introduced as disintegratable aggregates, as in EP 376,713.

The polymer particles can have been made by any convenient polymerisation technique including precipitation polymerisation or solution polymerisation, but generally will have been made by gel polymerisation or reverse phase bead polymerisation. Preferred particles are those that have been made by reverse phase bead polymerisation followed by drying and, if desired, comminution, for instance in conventional manner. Particles made by gel polymerisation followed by comminution and drying may also be used. If comminuted, the particles may be the entire product of the comminution (thus generally including a spread of particle sizes) or they may be a narrow fraction sieved from the entire product (for instance being the finer particles separated from the comminuted product).

When pelletising metal ore with a polymeric binder, it is well known to include a pelletising aid. Preferably such a material is used in the invention as part of the binder. The pelletising aid is normally a water soluble, monomeric material and suitable materials are described in EP 225,171 and 288,150 and in U.S. Pat. Nos. 4,767,449 and 4,802,914. Generally the materials are selected from sodium carbonate, sodium bicarbonate, sodium silicate, sodium phosphate, sodium stearate, sodium benzoate, sodium tartrate, sodium oxalate, sodium citrate, sodium acetate, the corresponding ammonium, potassium, calcium and magnesium salts of the preceding sodium salts, urea and calcium oxide, preferably sodium carbonate.

The total binder system used in the invention generally includes the binder polymer, the treatment polymer and one or more such pelletising aids. The weight ratio of binder polymer to pelletising aid is generally in the range 5:1 to 1:5, most preferably around 2:1 to 1:2, by weight. The ratio of binder polymer to treatment polymer is generally in the range 10:1 to 1:2, preferably 5:1 to 1:1, by weight. The amount of binder polymer in the intimate mixture is generally at least 0.005% and is usually at least 0.01%, but it is usually unnecessary for it to be more than 0.1%, based on the weight of the intimate mixture of ore, polymer binder and moisture.

If desired, bentonite can be included in the intimate mixture as an additional binder with, before or after the binder polymer.

The ore is generally an iron ore but it can be any other metallic ore which is to be pelletised, for instance a zinc ore. The amount of moisture will vary according to the ore and the process but is generally in the range 7 to 15%, often around 8 to 12% by weight. Some or all of this moisture may be introduced with the binder polymer and/or treatment polymer or by a deliberate addition of water, but often all the moisture is present in the ore and all the additives are added dry.

The methods of mixing and pelletisation can be conventional, for instance pelletisation can be by tumbling, rolling or balling. The particle size of the ore which is to be pelletised is usually 90% by weight below 100 $\mu$m, often below 50 $\mu$m.

The Following is an Example:

A haematite ore having around 10% (from 10.3 to 10.6%) moisture was blended with a powdered premix of polymer binder and pelletising aid and with powdered treatment polymer, all the powders having a size mainly below 100 $\mu$m. The resultant intimate mixture was subjected to pelletisation by using standard procedures to give pellets of size 11.2 mm to 13.2 mm. The wet strength, dry strength and drop number were recorded in conventional manner. In each of the tests the polymer binder was a copolymer of 35 wt % sodium acrylate and 65 wt % acrylamide having IV about 10 dl/g, the pelletising aid was sodium carbonate and the treatment polymer was sodium polyacrylate homopolymer of weight average molecular weight about 4,000 to 5,000. The results are shown in the following table.

| Test | Polymer Binder % | Pelletising Aid % | Treatment Polymer % | Moisture % | Wet Strength (kg) | Dry Strength (kg) | Drop Number |
|---|---|---|---|---|---|---|---|
| A | 0.025 | 0.025 | 0.01 | 10.2 | 1.35 | 6 | 8.7 |
| B | 0.02 | 0.02 | 0.02 | 10.1 | 1.23 | 6.1 | 5.3 |
| C | 0.015 | 0.015 | 0.03 | 10 | 1.21 | 5.82 | 4.5 |
| D | 0 | 0 | 0.06 | 9.5 | 1.28 | 4.25 | 1.1 |

-continued

| Test | Polymer Binder % | Pelletising Aid % | Treatment Polymer % | Moisture % | Wet Strength (kg) | Dry Strength (kg) | Drop Number |
|---|---|---|---|---|---|---|---|
| E | 0.03 | 0.03 | 0 | 10.5 | 1.3 | 4.12 | 6.6 |
| F | 0 | 0 | 0 | 9.3 | 1.07 | 1.26 | 1.9 |

Comparison of test E with tests A, B and C show that there is a significant improvement in dry strength without any significant loss in drop number, and in test A there is in fact an increase in drop number. This improvement in dry strength is achieved even though the total amount of binder system (polymer binder, pelletising aid and treatment polymer) is 0.06% in all the tests. Comparison of tests E and D shows that the treatment polymer gives a similar dry strength to the result which is obtained using the polymer binder and the pelletising aid alone, but that the drop number is greatly inferior.

Similar results are obtained when the same procedures are carried out replacing the binder polymer with (1) a copolymer of 20% sodium acrylate and 80 wt % acrylamide, having IV about 6 dl/g or (2) a copolymer of 20% sodium acrylate and 80 wt % acrylamide, polymerised in the presence of 10 ppm methylene bis acrylamide (MBA), and having IV about 6 dl/g.

What is claimed is:

1. An ore pelletisation process comprising adding binder polymer to particulate ore and moisture and thereby forming an intimate mixture of ore, binder polymer and moisture, forming green pellets from the mixture and firing the pellets, characterised in that a water soluble treatment polymer which has molecular weight 1,000 to 20,000 and which is a synthetic polymer formed by polymerisation of water soluble ethylenically unsaturated anionic monomer or water soluble ethylenically unsaturated monomer blend containing at least 50% by weight anionic monomer is included in the intimate mixture in an amount of at least 0.001% by weight.

2. A process according to claim 1 in which the treatment polymer is added in an amount of above 0.008% by weight of the mixture of ore, binder polymer and moisture.

3. A process according to claim 1 or claim 2 in which the treatment polymer is added as a liquid.

4. A process according to claim 1 in which the binder polymer is added in the form of a powder.

5. A process according to claim 4 in which the treatment polymer is added in the form of powder wherein the powder particles of the treatment polymer are separate from the powder particles of the binder polymer.

6. A process according to claim 4 in which the treatment polymer is added as a powder blend with the binder polymer.

7. A process according to claim 1 in which the treatment polymer is added separately from but substantially simultaneously with the binder polymer.

8. A process according to claim 1 in which the treatment polymer is added sequentially with the binder polymer.

9. A process according to claim 8 in which the treatment polymer is added (1) before the binder polymer or (2) partly before the binder polymer and partly with or after the binder polymer.

10. A process according to claim 1 in which the treatment polymer has molecular weight 2,000 to 10,000.

11. A process according to claim 1 in which the treatment polymer is a homopolymer of acrylic acid or a copolymer of acrylic acid with up to 20 wt. % of a comonomer selected from the group consisting of acrylamide, methyl acrylate and butyl acrylate, or an alkali metal salt thereof.

12. A process according to claim 1 in which the treatment polymer is a copolymer of 80 to 100 wt. % sodium acrylate with 0 to 20 wt. % of a comonomer selected from the group consisting of acrylamide, methyl acrylate and butyl acrylate.

13. A process according to claim 1 in which the treatment polymer is sodium polyacrylate having molecular weight 2,000 to 8,000.

14. A process according to claim 1 in which the binder polymer comprises synthetic ionic polymer, preferably at least 50 wt. % synthetic ionic polymer.

15. A process according to claim 1 in which the binder polymer consists essentially of synthetic ionic polymer.

16. A process according to claim 1 in which the binder polymer is a copolymer of 10 to 40 wt. % sodium acrylate and 90 to 60 wt. % acrylamide, having intrinsic viscosity 3 to 10 dl/g.

17. A process according to claim 1 in which bentonite is also included in the intimate mixture as a binder.

18. A process according to claim 1 in which the total amount of binder polymer plus treatment polymer is not more than 0.2% by weight of the intimate mixture.

* * * * *